US005279237A

United States Patent [19]

Alivizatos

[11] Patent Number: 5,279,237

[45] Date of Patent: Jan. 18, 1994

[54] METHOD OF MAKING A FLOATING BABY BATHER

[75] Inventor: Margaret A. Alivizatos, Dallas, Tex.

[73] Assignees: Maurice Adam, Dallas, Tex.;

[21] Appl. No.: 981,349

[22] Filed: Nov. 25, 1992

Related U.S. Application Data

[63] Continuation of Ser. No. 665,342, Mar. 6, 1991, abandoned.

[51] Int. Cl.[5] ..... D05B 1/00; A47K 3/024

[52] U.S. Cl. ..... 112/262.3; 5/655; 5/911; 4/572.1

[58] Field of Search ..... 4/572.1, 578.1, 573.1, 4/579, 560.1, 659, 494, 496; 5/638, 655, 911; 441/106, 88, 129, 127, 130; 112/262.3, 262.1, 10, 2.1

[56] References Cited

U.S. PATENT DOCUMENTS

| | | | |
|---|---|---|---|
| 909,453 | 1/1909 | Pullman . | |
| 1,960,474 | 5/1934 | Browne . | |
| 3,528,116 | 9/1970 | Fenar . | |
| 3,616,470 | 11/1971 | Young et al. | 5/337 |
| 4,607,403 | 8/1986 | Alivizatos | 5/449 |
| 4,693,691 | 9/1987 | DeYoe | 441/129 |
| 4,980,937 | 1/1991 | Mason et al. | 5/431 |
| 5,182,828 | 2/1993 | Alivizatos | 5/911 X |

FOREIGN PATENT DOCUMENTS

| | | | |
|---|---|---|---|
| 66092 | 12/1892 | Fed. Rep. of Germany | 4/572.1 |
| 1550108 | 8/1979 | United Kingdom | 441/130 |

*Primary Examiner*—Clifford D. Crowder
*Assistant Examiner*—Paul C. Lewis
*Attorney, Agent, or Firm*—Hubbard, Thurman, Tucker & Harris

[57] ABSTRACT

A baby bather has an open mesh coated fabric envelope filled to a soft cushion shape with lightweight buoyant foam plastic beads for supporting a baby floating in a tub or over a sink. The center portion of the cushion has a gradual depression having a centrally located panel for free flow of water. The cushion facilitates bathing, provides support and protection for baby's head, and is completely non-absorbent, machine washable and quick drying. Methods of manufacture are provided.

19 Claims, 3 Drawing Sheets

METHOD OF MAKING A FLOATING BABY BATHER

CROSS REFERENCE TO RELATED APPLICATIONS

This is a continuation of U.S. patent application Ser. No. 07/665,342 now abandoned by the same inventor filed Mar. 6, 1991, filed as above for which benefit is claimed.

BACKGROUND OF THE INVENTION

1. Field of the Invention

The invention relates to devices for simplifying the bathing of infants in a floating cushion infant support.

2. Background

Infants and small babies frequently need washing and bathing to keep them clean and in good health. They are vulnerable to being injured during the bathing operation and, during the early months of life, the baby's head must be supported at all times because the little neck is not strong enough.

It is difficult for the caretaker of the baby to support the baby and still perform the bathing operation with the other hand. In addition, babies are often provided with slippery oils to help control redness and chapping which makes it more difficult to keep the baby from slipping out of the hands of the caretaker. Soap itself is slippery when applied. It is difficult to support a slippery, squirming baby.

Although it is possible to place the baby on a flat surface, thus freeing both hands to use a washcloth, it is more desirable to periodically bathe the infant at a sink or tub where the water can be freely splashed over the surface of the baby's body.

SUMMARY OF THE INVENTION

The invention provides a way to support a baby in such a way so that both of the caretaker's hands are free to perform the bathing operation. A floatable baby bather is provided having a baby support cushion with a drain panel located in a central portion thereof, the drain panel freely passing water from the upper side thereof and communicating with the remainder of the water in the tub. The cushion has a fabric envelope connected to the drain panel for enclosing floatable cushion filler material around the drain panel. The filler material is enclosed within the fabric envelope in sufficient quantity to easily float the cushion and the weight of the baby when it is placed thereon. The cushion has an upper surface panel and a lower surface panel formed by the fabric envelope, the upper surface panel having a baby support surface which curves downwardly and inwardly from the upright outer periphery or side edge thereof toward the drain panel. The floatable cushion completely surrounds the drain panel which is centrally located with respect to the surrounding support cushion. The baby is nestled within the support cushion with the lower part of its body supported by the drain panel portion of the bather. The support cushion is longer and wider than the baby so that the baby is protected from bumping its head when it is resting on the upper surface of the support cushion.

The upper and lower outer periphery of the fabric envelope panels may be joined or they may be spaced apart and joined by an upright side edge panel extending around the outer periphery. In such case, the cushion may be thickest near the junction of outer side edges of the upper and lower panels and the edge panel, the upper and lower panels curving axially inwardly toward each other from near the outer sides until they meet in contact with the edge of the centralized drain panel where a seam is formed. The gradually downward curving upper panel surface is a baby support surface which supports the upper body and legs of the baby on opposite sides of the drain panel, the drain panel providing support for the baby's bottom or rump.

The overall shape of the cushion is rectangular when viewed from above, although an oval or some other baby supportive shape can be used. The upper and lower panels join to enclose a support chamber for enclosing a multiplicity of lightweight, expanded plastic foam beads in sufficient quantity to safely and easily provide floating support for a baby placed on the cushion.

A method of construction is provided which is used to create a cushion around the drain panel with hidden seams and a tendency to retain its shape around the outer edges and sides of the finished bather. It is preferably formed from a single, specially shaped fabric.

A particular advantage of the floatable baby bather drives from the use of an envelope forming a cushion chamber for holding the plastic beads, which is made from an open mesh fabric and is relatively nonabsorbent, in combination with the extremely lightweight, expanded plastic beads which do not absorb water. Preferably, synthetic mesh fabric which is soft and pliable is best suited for the envelope. Since neither the fabric nor the floatable expanded plastic beads, such as polystyrene beads, absorb water, the baby bather quickly and easily dries in the air after use. These materials are also hypoallergenic, mildew resistant and nonretentive of any odors. Another advantage is that the baby bather is completely washable, and since it dries quickly, it is soon ready for reuse.

DETAILED DESCRIPTION

Figure 1:
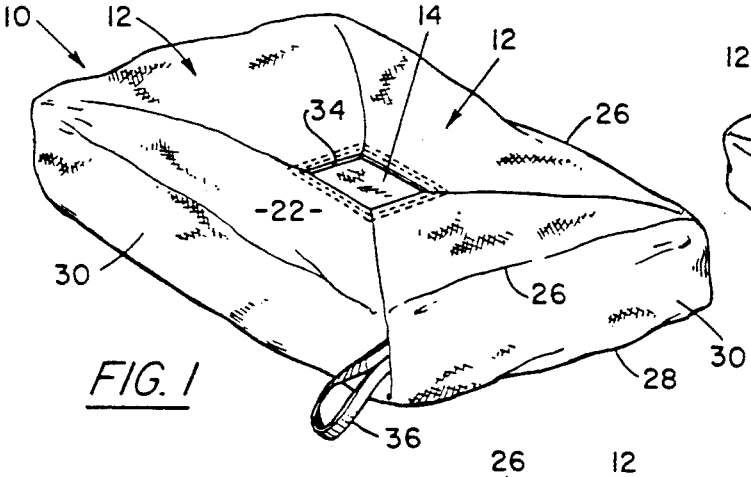
FIG. 1 is a perspective of the view of the baby bather.
Figure 2:
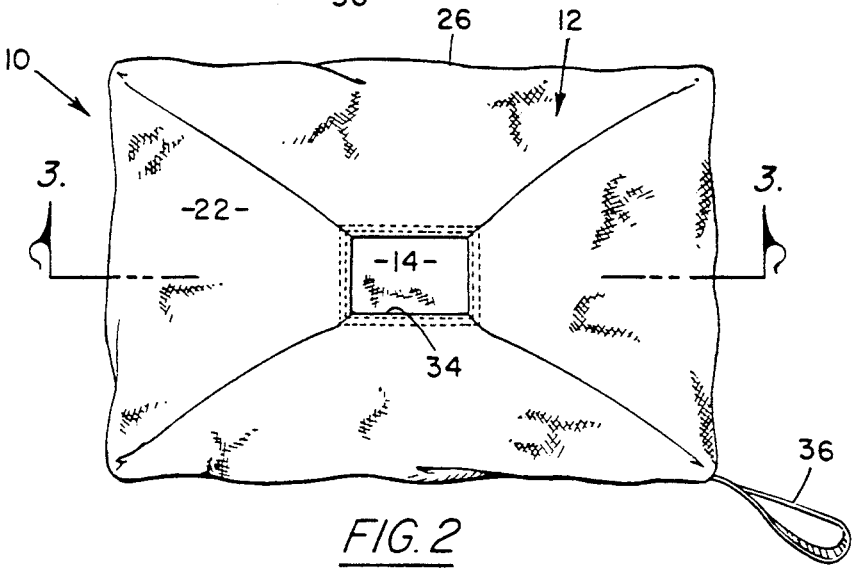
FIG. 2 is a top plan view of the baby bather.
Figure 3:
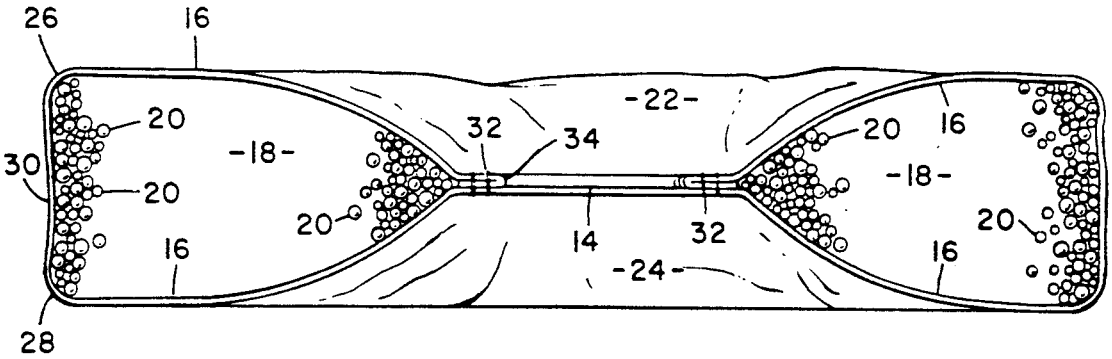
FIG. 3 is a cutaway cross-section of the baby bather on the longitudinal center line.
Figure 5:
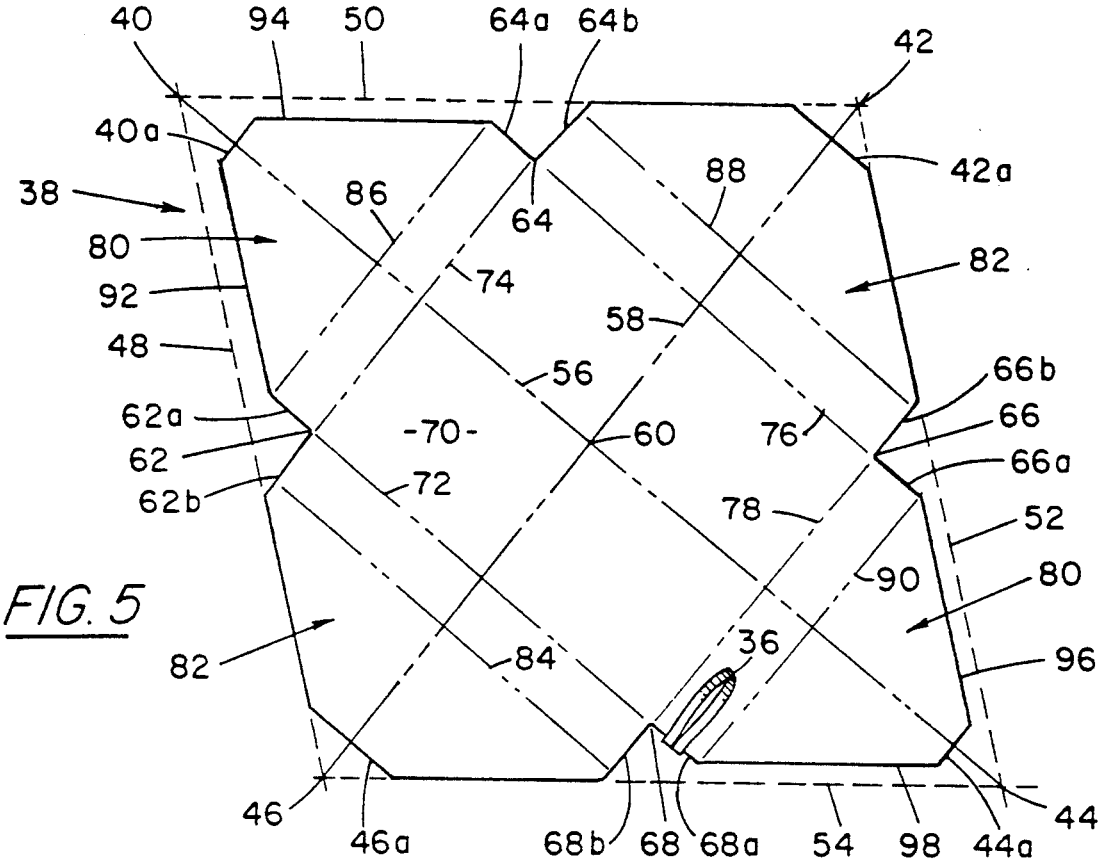
FIG. 5 is a plan view looking straight down on the laid out fabric envelope which is used to form the bather.

A floatable baby bather designated generally by the reference numeral 10 in FIG. 2 is shown in FIGS. 1–4. The floatable baby bather 10 has a baby support cushion 12 surrounding a drain panel 14. Drain panel 14 is made from an open mesh fabric material which freely passes water therethrough. Cushion 12 is formed from a fabric envelope 16 best seen in the cross-section of FIG. 3. Fabric envelope 16 is connected to drain panel 14, and as indicated in FIG. 3, may constitute a continuation of fabric envelope 16. Fabric envelope 16 encloses a support chamber 18 which continues all around the drain panel 14. The drain panel 14 is centralized within the cushion 12 formed by the fabric envelope 16.

The support chamber 18 is filled with a floatable filler material which is preferably a multitude of lightweight polystyrene foam beads 20. A sufficient quantity of filler material, such as polystyrene beads 20, is enclosed to easily float the bather 10 and the weight of a baby when one is placed on the cushion for bathing. The cushion 12 formed around the drain panel 14 is longer and wider than the baby to provide a cushioned area so that baby's head cannot be bumped against the edge of the tub or sink.

Figure 4:
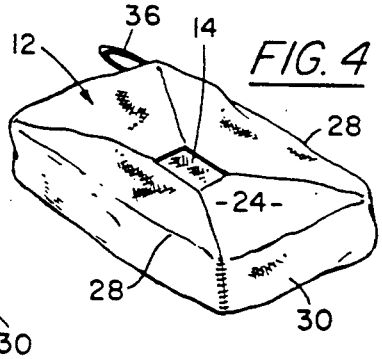
FIG. 4 is a perspective view showing the underside of the bather of FIG. 1.

FIG. 1 shows the upper surface panel 22 and FIG. 4 shows the lower surface panel 24. Upper surface panel 22 has an outer side or perimeter edge 26 and lower surface panel 24 has an outer side or perimeter edge 28. It is understood that the upper surface panel 22 in FIG. 2 forms the entire outline of the cushion 12. In addition, the upper and lower side edges 26,28 of upper and lower panels 22,24 are spaced apart and joined by an edge panel 30 extending around the outer periphery. Edge panel 30 may be seen as a separate panel extending around the outer periphery and joining the upper and lower panels, or as a continuation of the upper and lower panels in a vertical direction. As seen in FIGS. 1–4, the cushion may be described as having a generally rectangular shape having four rectangular corner portions and an upright or upstanding outer side edge portion 30 between the corners which define opposite sides and opposite ends of the cushion. Because of some slight bulging out of the side edge portions, the thickness of the cushion may be greatest near the upright side edges around the outside of the cushion a short distance in from the outer edges.

Upper surface panel 22 is seen as a baby support panel and, as best seen in FIG. 3, it curves downwardly from near the outer side edges toward the drain panel 14. Likewise, the lower surface panel 24 curves upwardly from near the outer side edges toward the drain panel 14. Thus, it may be said the upper and lower surface panels curve axially inwardly toward each other from near the outer side edges until they meet in contact with the edges of the drain panel 14 where a seam 32 is formed. The term axially in this context refers to the axis of a line running perpendicularly through the center of panel 14.

The drain panel may be seen as having an inner peripheral edge 34 which, as best seen in FIG. 2, forms a rectangular area, which is substantially coextensive with the inner peripheral edge of the support chamber 18, where the upper and lower panels 22,24 come together around the drain panel 14 to form the fillable chamber for the cushion 12. In FIG. 3, there is a small overlap of the inner peripheral edge of the upper panel 22 so that the seam 32 can be formed smoothly and neatly. It should be recognized that alternately, the panel 14 could be a continuation of the upper panel 22 rather than the lower panel 24, and the lower panel 24 could be overlapped at the perimeter 34 to form the seam 32. Still further, the panel 14 could be a separate piece which is seamed around the inner peripheral edge 34 by the seam 32. The seam 32 can be formed as a sewn seam or it could be made by heat sealing with proper selection of fabric to form envelope 16. Finally, a convenient handle strap and hanger 36 is connected to the edge panel 30.

A method of forming the baby bather having a rectangular shape is illustrated in FIGS. 5–8. Surprisingly, a rectangular-shaped structure is formed from a blank generally designated by the reference numeral 38 in FIG. 5, which has a general outline shape of a parallelogram. The parallelogram outline of the original blank is indicated by the phantom dotted edges around the outside of FIG. 5, which designate original corners 40, 42, 44 and 46. The original blank had opposite and parallel side edges 48, 50, 52 and 54. Part of the original side edges of two opposite triangular-shaped corner portions have been cut away so that there will be an overlap for seaming when opposite flap portions are ultimately folded over to create the structure.

The blank may be said to have a first or long axis 56 and a second or short axis 58 which intersect at the center 60 of the blank. These axes pass respectively through opposite original corners 40,44 and opposite original corners 42,46.

Intermediate the original corners, each side edge of the blank is notched with notches having substantially the same depth 62, 64, 66 and 68 which is in the form of the apex of a substantially right angled triangle having a base lying along the original edges of the blank. The side edges **62*a*, 62*b* of notch 62 lie offset and parallel to one of the axes 56,58. Side edge 62*a* lies parallel to axis 56 and side edge 62*b* lies parallel to axis 58. Similarly, notches 64*a*, 66*a*, and 68*a*, of respective notches 64, 66, and 68, also lie parallel to axis 56 and side edges 64*b*, 66*b* and 68*b* respectively of notches 64, 66, and 68, lie parallel to axis 58. The inwardly extending corners 62, 64, 66, and 68 form a generally rectangular base 70 indicated by fold lines 72, 74, 76 and 78. These are lines on which the structure will be folded. The rectangular base 70 corresponds to the lower panel 24 in FIG. 4. The center 60 is also the center of the rectangular base 70**.

The creation of the adjacent notches on each side of a corner with the attendant fold lines at the deepest part of the notch produces two sets of oppositely oriented flaps. A first set of oppositely oriented flaps 80 is created by notches 62,64 and 66,68 which fold at fold line 74,78 toward the center. The first set of flaps is bisected by the first axis 56. A second set of oppositely oriented flaps 82 is created by the notches 64,66 and 62,68 which fold over to the center along fold lines 72,76 and are bisected by the second axis 58. Fold lines 72,74,76,78 may be referred to as the lower fold lines. The first set of opposite flaps is generally designated by the reference numeral 80 and the second set of opposite flaps is designated generally by the reference numeral 82. Spaced apart and parallel to the lower set of fold lines 72,74,76,78 are an upper set of fold lines 84,86,88 and 90.

Part of the edges of one of the sets of opposite flaps are trimmed away parallel to the original edges of the blank to meet the sides of the notch at an angle which defines the end of the upper fold lines. Flap 80 is trimmed to form edges 92,94 and opposite flap 80 is trimmed to form edges 96,98. Because the trimmed edges terminate at side edges of the notches which constitute the upper fold lines 86,90, and because the edges **62*a*, 64*a*, 66*a*, 68*a*** are all the same length, the trimmed side edges of the flaps will form diagonals with respect to the rectangular base when they are folded over at the fold lines. The diagonals will run between each corner of the base rectangle to the center.

The height of the cushion to be formed around the peripheral edges will be established by the height of the edges **62*a* through 68*a* of the notches. This means the untrimmed opposite set of flaps 82 will be folded at fold lines 84,88 which are spaced the same distance away from the edges of the base rectangle as upper fold lines 86,90 so that additional material for an overlap seam will be provided, because the untrimmed side edge of the notches, 62***b*, 64*b*, 66*b* and 68*b* are longer and extend out beyond the fold lines 84 and 88. Thus the edges of the opposite flaps may be said to be able to be brought together in a seaming relationship so that seams of the type shown in FIG. 7 may be formed.

Figure 6:
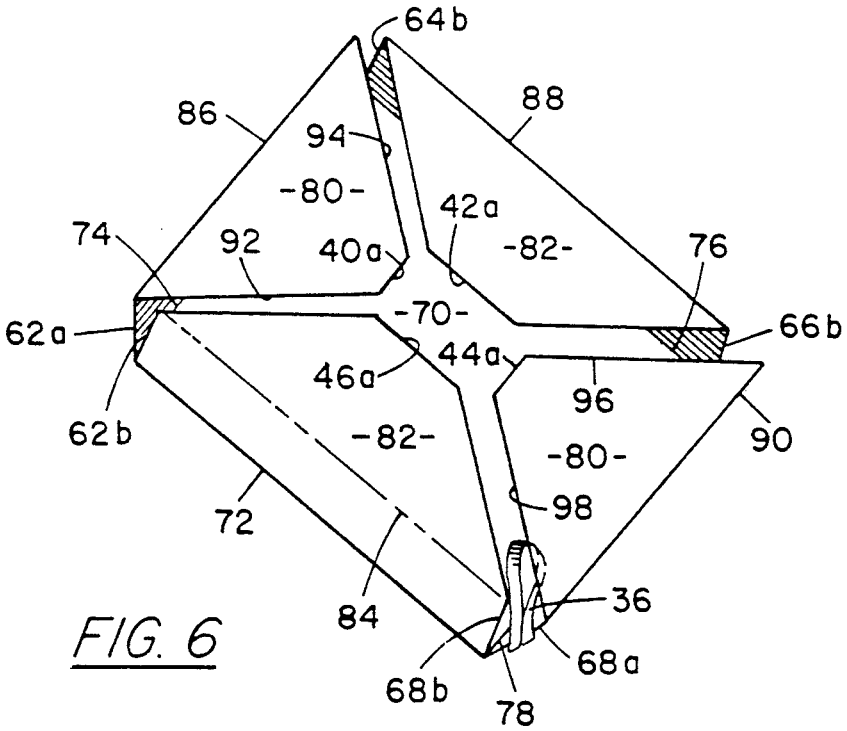
FIG. 6 is a perspective view showing how the envelope of FIG. 5 is folded.
Figure 7:
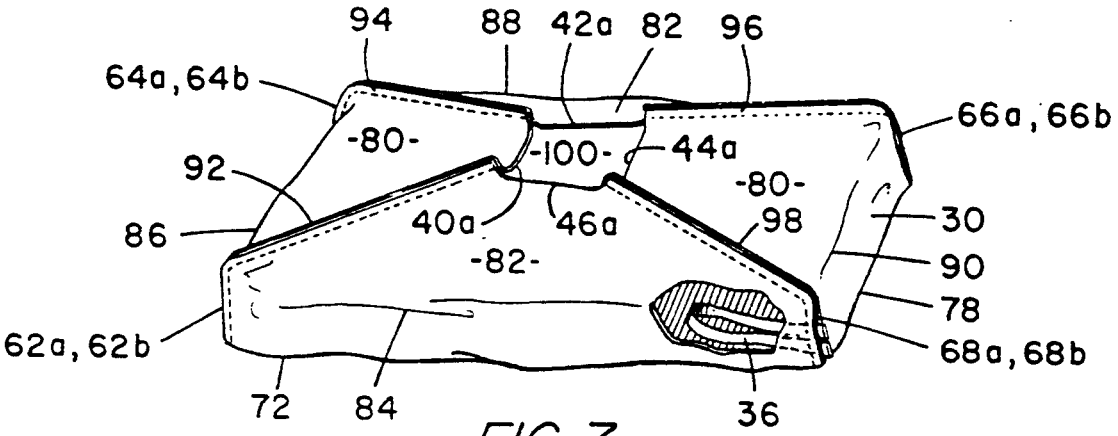
FIG. 7 is a perspective view of the folded envelope of FIG. 6 after seams are formed and before inversion.
Figure 8:
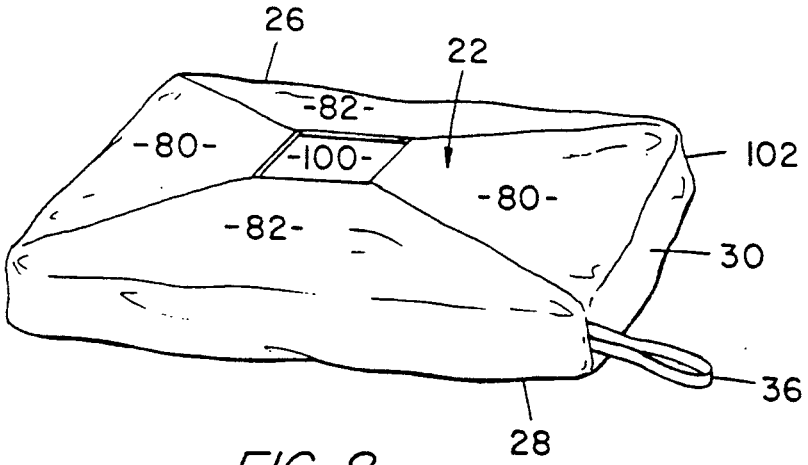
FIG. 8 is a perspective view of the envelope of FIG. 7 which has been inverted and which lacks only seams for the drain panel and one corner, to complete the bather envelope.

The triangular corners are cut off the flaps to form drain panel edges. The opposite cut corners 40*a*, 44*a* of opposite flaps 80 are cut perpendicular to the axis 56 and are equal in length. The opposite corners 42*a*, 46*a* of the opposite flap 82 are cut perpendicular to the axis 58 and are of equal edge length. This makes it possible to form a geometric figure when the opposite sets of flaps are folded toward the center. The outline of the cut corner edges 40*a*, 42*a*, 44*a* and 46*a* forms a geometric figure as indicated in FIGS. 6–8. The cut edges of the opposite corners will, when brought together, form a geometric figure, in this case a rectangle, which is centered at the center of the rectangular base and is defined by the opposite cut edges of the flaps.

With the goal in mind of producing the structure of FIG. 1, the opposite sets of flaps are folded upwardly and inwardly toward the center as indicated in FIG. 6 so that the upper fold lines are substantially vertically above the lower fold lines of the base rectangle 70. It will be seen that by folding the opposite sets of paired flaps inwardly toward the center along the upper and lower fold lines, the cut edges 96,98 are brought into seaming relationship with the adjacent original uncut edges of one of the flaps of the set 82. Similarly, the cut edges 92,94 of the opposite flap 80 are brought into seaming relationship with the adjacent respective original uncut edges of the adjacent flaps of the set 82.

FIG. 7 shows the next step in the operation wherein after folding the opposite flaps toward the center along the opposite side edges of the rectangular base at the fold lines, the opposite side edges of adjacent flaps are in slightly overlying relationship along diagonals of said rectangular base where the edges are seamed as indicated in FIG. 7. Edges 92 and 94 of one of the flaps 80 are each seamed to the original adjacent edges of the opposite flaps 82 which are slightly overlapped and seamed. Edges 96 and 98 of the opposite flap 80 are mated with the original adjacent untrimmed edges of the opposite flaps 82 on either side and seamed as indicated in FIG. 7. It might be noted that the upper fold lines 84,86,88 and 90 correspond to the lower peripheral edge 28 in FIG. 1 because the whole structure must be inverted through the opening 100 and then turned over. It is turned inside out to hide the seams.

The area between the fold lines corresponds to the edge panel 30 of the finished baby bather structure. When the panels are folded toward the center, the side edges of the notches are brought together in seaming relationship and the side edges of the notches 68*a*, 68*b* of notch 68, side edges 62*a*, 62*b* of notch 62 and side edges 64*a*, 64*b* of notch 64 are seamed. Although the side edges 66*a*, 66*b* of notch 66 are brought together in seaming relationship, they are left unseamed to serve as a filler opening 102 for filling the enclosed chamber with floatable beads. Because of the way these seams are formed, they provide a structural integrity to the cushion which tends to retain the cushion's shape and create the cavity or enclosure, especially around the peripheral edge. It will be noted that the cut edges of the corners 40*a*–46*a* form a geometrical figure in the center which begins to take the shape of the drain panel 14.

The FIG. 7 structure is inverted and shown in FIG. 8. This is done by folding the material back through the opening 100 and turning the structure inside out so that the seams are hidden on the interior of the upper and lower panels 22,24 which are formed and which are referred to in FIG. 1. The portions of the opposite flaps 80,82 extending beyond the upper fold lines toward the center will form the upper surface panel 22 of the enclosure. The upper fold lines form the outer upper peripheral edge 26 and the lower fold lines form the lower outer peripheral edge 28. In FIG. 8 the filler opening is designated 102 which is the side edges 66*a*, 66*b* of the notch 66.

In order to complete the structure from that shown in FIG. 8 to the completed baby bather shown in FIGS. 1–4, it is only necessary to seam the centered geometric figure represented by the opening 100, to the rectangular base of the blank in order to form the drain panel 14 as shown in FIG. 2. The edges around the opening 14 are preferably folded under to form the inner peripheral edge 34. Then the fabric envelope forms an enclosure or cavity which is support chamber 18 around the seamed drain panel 14. The enclosure is then filled with lightweight, floatable plastic beads through the filling opening 102 and then the filling opening 102 is seamed shut. It is within the scope of the invention that the term "seaming" include sealing or adhesive bonding with proper selection of fabric, although the structure is preferably seamed by sewing.

It is also possible to make the structure from an essentially square blank or even from a pair of square blanks. This can be done by folding the sheet in half in superposed relationship to form an upper panel and a lower panel, seaming two adjacent edges leaving the last edge open or partially open and turning the envelope inside out. Then a centrally located drain panel opening can be cut in the center of one of the overlapped panels and the edges of the opening seamed to the other panel. Then the remaining opening can be used to fill the volume between the overlapped upper and lower panels around the seamed opening with lightweight floatable beads to form the cushion portion and the remaining open seam closed. Alternately, separate first and second rectangular panels can be provided, one placed over the other and three of the edges seamed before inverting. The fourth edge might be partially seamed to leave a small filler opening. However, these methods do not provide the same upstanding outer peripheral edges of the finished cushion which is provided by the method previously described.

In the best mode, the fabric envelope is preferably made from an open mesh, polyester fabric which is coated. The fabric has visible air and water permeable openings between the threads which are small enough to retain polyester beads or particles from crushed or partially formed beads. The fabric and especially the preferable polystyrene filler beads are insulating and greatly assist in infant thermal regulation and in offering the infant a feeling of warmth and security in contact with the skin. An open mesh fabric having an $18\times15$ thread per inch polyester scrim base with a respective denier of $600\times840$ coated with PVC vinyl has been used successfully. The fabric has a total thickness of about 0.016 inches and weighs about nine ounces per square yard.

The floatable filler material is preferably spherical, resilient plastic beads formed from an expanded cellular plastic, expanded to a diameter in the range of about 0.062 inches to 0.18 inches and is substantially liquid impermeable and extremely lightweight. The fabric envelope is not tightly packed so that it is easy to form a partial depression which aids in holding the baby. The use of the polystyrene beads or spheres provides a non-permeable filler material which will not retain moisture or harbor bacteria and it is particularly advantageous as compared with the use of shredded or open cell plastic materials. The completed baby bather is mildew resistant and fully washable and because it does not absorb water, it quickly air dries. The washable, lightweight material does not absorb odors and is completely buoyant and floats. A rectangular shape is preferred to accommodate the shape of a baby without utilizing an unnecessary amount of materials or unduly increasing the size.

Although preferred embodiments of the present invention have been described here in detail, those skilled in the art will recognize the various substitutions and modifications which may be made to the specified structures and methods of fabrication without departing from the scope and spirit of the invention as recited in the appended claims.

I claim:

1. A method of forming a floatable baby bather having a central drain panel surrounded by cushion portions connected to edges of the drain panel and fillable with lightweight floatable beads containable within the cushion portions, comprising:

providing a blank having four opposite corners and opposite parallel side edges, said blank having a first axis passing through two opposite corners and a second axis passing through two other opposite corners and intersecting said first axis at a geometric center;

notching each side edge of the blank with notches having substantially the same depth the notches having side edges parallel but offset from said first and second axes to create a first set of oppositely oriented flaps and a second set of oppositely oriented flaps, the first set of flaps being bisected by said first axis and the second set of flaps being bisected by said second axis;

cutting the corners off the flaps to form drain panel edges and folding the opposite sets of flaps toward the center so that a drain panel is formed by the drain panel edges and the edges of each notch are brought together in a seaming relationship at corners of the cushion to be formed and adjacent edges of the adjacent flaps are in seaming relationship with each other;

seaming adjacent edges of adjacent flaps to each other and seaming the adjacent edges of each notch except for a filling opening;

inverting the structure; and seaming the drain panel edges to the blank.

2. The method of claim 1 further including the steps of:

filling the structure through the filling opening with lightweight floatable beads; and seaming the filling opening to enclose the cushion around the drain panel.

3. The method of claim 1 wherein the first and second axes are of different lengths.

4. The method of claim 2 wherein the first and second axes are of different lengths.

5. The method of claim 4 wherein the blanks are provided by cutting from a lengthy web, successive blanks by cutting angularly across the web.

6. A method of forming a floatable baby bather having a central drain panel surrounded by cushion portions connected to edges of the drain panel and fillable with lightweight floatable beads containable within the cushion portions, comprising:

providing a parallelogram-shaped blank cut from a web of open-mesh envelope fabric material, having a center point defined by the intersection of a long axis and a short axis;

defining a rectangular base by cutting triangular notches from opposite side edges of the parallelogram-shaped blank, the base having a long axis and a short axis passing through the center point, being the center of said rectangular base;

cutting opposite triangular corners off the parallelogram-shaped base perpendicular to the long and short axes to create flaps having opposite cut edges that can be folded along the rectangular base toward the center to meet in the form of a small geometric figure centered in the center of the rectangular base defined by the opposite cut edges of said flaps;

folding said opposite flaps toward the center along the opposite side edges of the rectangular base so that opposite side edges of adjacent flaps are in slightly overlying relationship along diagonals of said rectangular base;

seaming the overlapping edges of adjacent flaps and the opposite edges of the triangular notches except for a filling opening;

seaming the centered geometric figure to the rectangular base creating an enclosure around said figure;

filling the enclosure with floatable beads through the filling opening; and seaming and filling opening.

7. The method of claim 6 wherein the blanks are provided by cutting from a lengthy web, successive blanks by cutting angularly across the web.

8. A method of forming a floatable baby bather having a central drain panel surrounded by cushion portions connected to edges of the drain panel and fillable with lightweight floatable beads containable within the cushion portions, comprising:

providing a rectangular web of open mesh envelope fabric material;

folding the sheet in half in superposed relationship to form an upper panel and a lower panel;

seaming two adjacent edges leaving a last open edge;

turning the envelope fabric inside out;

cutting a centrally located opening in one of the overlapped panels;

seaming the edges of the opening in said one panel to the other panel;

filling the volume between the overlapped upper and lower panels around the seamed opening with lightweight floatable beads to form the cushion portions; and seaming the last open edge of the envelope to enclose the beads in the cushion.

9. The method of claim 8 wherein the step of seaming the two adjacent edges includes seaming part of the last open edge to leave an opening for inverting and filling the envelope.

10. A method of forming a floatable baby bather having a central drain panel surrounded by a cushion portion connected to edges of the drain panel and fillable with lightweight expanded plastic beads containable within the cushion portion, comprising:

providing a first rectangular web of open mesh envelope fabric material;

cutting a centrally located drain panel and inverting opening in said first web;

superposing a second rectangular web of open mesh envelope fabric material upon said first web;

seaming the peripheral edges of said superposed fabric webs to form a cushion structure;

inverting said cushion structure through said drain panel and inverting opening;

seaming part of the edges of the drain panel and inverting opening to said second web to leave a filling opening;

filling the volume between the first and second webs with lightweight expanded plastic beads through the filling opening; and seaming the filling opening.

11. The method of claim 10 wherein step of cutting a centrally located drain panel and inverting opening is performed on said second web instead of said first web.

12. A method of forming a floatable baby bather having a central drain panel surrounded by cushion portions connected to edges of the drain panel and fillable with lightweight floatable beads containable within the cushion portions, comprising:

providing a lengthy web of open mesh envelope fabric material;

severing a parallelogram-shaped blank from the web by cutting angularly across the width of the web;

forming truncated edges at the corners by cutting a triangularly-shaped portion from each of the four corners of the blank so that diametrically opposite corners are truncated similarly across from each other on a line through the center of the blank;

notching the edges of the blank approximately equidistant from adjacent corners of the blank;

folding opposite truncated corner edges of the blank toward each other and toward the center, so that they can be placed in the central area oppositely spaced apart with the corner edges forming a geometric figure and the edges on opposite sides of each notch in superposed abutting orientation;

seaming together the superposed edges on opposite sides of each notch with the truncated corner edges forming said geometric figure on the center of the blank to form a partially enclosed cushion;

seaming the notches shut except for a filler opening;

inverting the partially enclosed cushion to hide the already formed seams;

seaming the truncated corner edges to the center portion of the blank to create a centralized panel and an enclosure surrounding said panel;

filling the enclosure and seaming the filler opening.

13. The product formed by the method of claim 1.

14. The product formed by the method of claim 2.

15. The product formed by the method of claim 3.

16. The product formed by the method of claim 6.

17. The product formed by the method of claim 8.

18. The product formed by the method of claim 10.

19. The product formed by the method of claim 12.

* * * * *